US010710793B2

(12) United States Patent
Shimizu

(10) Patent No.: US 10,710,793 B2
(45) Date of Patent: Jul. 14, 2020

(54) AEROSOL NOZZLE

(71) Applicant: TOYO AEROSOL INDUSTRY CO., LTD., Tokyo (JP)

(72) Inventor: Hirokazu Shimizu, Tokyo (JP)

(73) Assignee: TOYO AEROSOL INDUSTRY CO., LTD., Tokyo (JP)

( * ) Notice: Subject to any disclaimer, the term of this patent is extended or adjusted under 35 U.S.C. 154(b) by 48 days.

(21) Appl. No.: 15/889,437

(22) Filed: Feb. 6, 2018

(65) Prior Publication Data

US 2018/0162630 A1 Jun. 14, 2018

Related U.S. Application Data

(63) Continuation of application No. PCT/JP2015/072755, filed on Aug. 11, 2015.

(51) Int. Cl.
*B65D 83/68* (2006.01)
*B65D 83/28* (2006.01)

(52) U.S. Cl.
CPC ..... *B65D 83/682* (2013.01); *B65D 83/28* (2013.01); *B65D 83/68* (2013.01)

(58) Field of Classification Search
CPC ..... B65D 83/682; B65D 83/28; B65D 83/68
USPC ..... 239/407, 423, 433, 303–305, 333, 337
See application file for complete search history.

(56) References Cited

U.S. PATENT DOCUMENTS 4,773,562 A 9/1988 Gueret
6,082,588 A * 7/2000 Markey ..... B05B 11/3084 222/135
6,672,483 B1 * 1/2004 Roy ..... B05B 11/0038 222/145.1
8,328,118 B2 * 12/2012 Hansen ..... B65D 83/202 239/304
2013/0175297 A1 7/2013 Sugimoto et al.

FOREIGN PATENT DOCUMENTS

CN 200988015 Y 12/2007
DE 3729491 A1 3/1988
JP S48-26967 Y 8/1973
(Continued)

OTHER PUBLICATIONS

International Search Report dated Sep. 29, 2015, issued in Counterpart of International Application No. PCT/JP2015/072755 (1 page).

(Continued)

*Primary Examiner* — Steven J Ganey
(74) *Attorney, Agent, or Firm* — Westerman, Hattori, Daniels & Adrian, LLP

(57) ABSTRACT

Provided is a simple-structured aerosol nozzle capable of mixing a plurality of contents uniformly and ejecting the same, and moreover leaving only a small amount of contents inside the flow passage after ejection. An aerosol nozzle 100 includes a nozzle lower part 120 that fits with a plurality of stems 103, and a nozzle upper part 110. At least one of an upper abutment surface 122 of the nozzle lower part 120 and a lower abutment surface 112 of the nozzle upper part 110 has a converging groove 126 that forms a plurality of converging passages 131 that connect openings of stem-communicated passages 123 and an opening of a mixing passage 111 when the nozzle lower part 120 and nozzle upper part 110 are fitted with each other.

8 Claims, 10 Drawing Sheets

II-II

(56) References Cited

FOREIGN PATENT DOCUMENTS

| | | | |
|---|---|---|---|
| JP | H10-17041 | A | 1/1998 |
| JP | 10-101157 | A | 4/1998 |
| JP | H11-11554 | A | 1/1999 |
| JP | 2001-278369 | A | 10/2001 |
| JP | 2001-341786 | A | 12/2001 |
| JP | 2002-179167 | A | 6/2002 |
| JP | 2004-217245 | A | 8/2004 |
| JP | 2005-35631 | A | 2/2005 |
| JP | 3865193 | B2 | 1/2007 |
| JP | 3904806 | B2 | 4/2007 |
| JP | 2012-51582 | A | 3/2012 |
| JP | 2012-082012 | A | 4/2012 |
| JP | 2013-79082 | A | 5/2013 |
| WO | 2008/053311 | A2 | 5/2008 |

OTHER PUBLICATIONS

Office Action dated Aug. 6, 2019, issued in counterpart JP application No. 2017-534070, with English translation. (6 pages).
Office Action dated Oct. 18, 2019, issued in counterpart KR application No. 10-2018-7001720, with English translation. (8 pages).
Office Action dated Dec. 3, 2019, issued in counterpart CN application No. 201580081836.1. (7 pages).

* cited by examiner

V-V

VI-VI

AEROSOL NOZZLE

TECHNICAL FIELD

The present invention relates to an aerosol nozzle having a nozzle lower part that fits with a plurality of stems protruding from the aerosol container and a nozzle upper part that fits with the nozzle lower part, the aerosol nozzle being mounted to the aerosol container to eject contents.

BACKGROUND ART

As before, nozzles mounted to aerosol containers that have a plurality of stems to eject the contents are known.

The nozzle known from Patent Literature 1, etc., for example, has an ejection head that is fitted to two stems protruding from a pair of aerosol containers fixed in relative positions. A lever disposed above this ejection head is pressed down to push down the ejection head including the stems, whereby the two types of contents flowing out of the aerosol containers through the stems are mixed inside the ejection head, and ejected out of the nozzle thereafter.

The nozzle known from Patent Literature 2, etc., for example, has a joint member that is fitted to two stems protruding from a pair of aerosol containers fixed in relative positions, and a flow passage formed by a cover member fitted with the joint member. An upper part of the cover is pushed down, whereby the stems are pressed down, so that the two types of contents flowing out of the aerosol containers through the stems are mixed in a mixing compartment in the flow passage, and ejected out of the nozzle thereafter.

CITATION LIST

Patent Literature

Patent Literature 1: Japanese Patent No. 3865193
Patent Literature 2: Japanese Patent No. 3904806

SUMMARY OF INVENTION

Technical Problem

While these known nozzles are configured such that a plurality of contents are mixed in a stirring compartment or mixing compartment, there was a concern that the contents might not be mixed uniformly enough before being ejected because the flow passage and stirring compartment or mixing compartment had a large capacity.

The structure of the stirring compartment or mixing compartment could be better designed in order to achieve uniform mixing, which, however, may require an increase in the number of components or make the structure complex, and lead to the problem of increased production and assembling costs.

The flow passage and stirring compartment or mixing compartment with a large capacity also involved a concern that the contents plentifully remaining inside the flow passage after ejection might flow out of the nozzle and stain the can body, hand, or clothes.

There were also risks that the residual contents would harden and obstruct normal ejection next time around, and that deteriorated or bacteria-contaminated residues might be mixed in the contents and ejected.

The nozzle could be disassembled and cleaned to reduce the contents that remain inside the flow passage after ejection, which, however, would increase the trouble for the user, and lead to the problem that some of the contents would be lost by the cleaning.

The present invention solves the problems described above, and it is an object of the invention to provide a simple-structured aerosol nozzle capable of mixing a plurality of contents uniformly and ejecting them and moreover leaving only a small amount of contents inside the flow passage after ejection.

Solution to Problem

The aerosol nozzle according to the present invention is an aerosol nozzle including a nozzle lower part that fits with a plurality of stems protruding from an aerosol container, and a nozzle upper part that fits with the nozzle lower part. The nozzle lower part includes stem fitting parts that fit with the plurality of stems respectively, an upper abutment surface, stem-communicated passages that open in the upper abutment surface and extend through the nozzle lower part from the stem fitting parts, and a converging groove provided in the upper abutment surface to connect openings of the plurality of stem-communicated passages. The nozzle upper part includes a lower abutment surface, and a mixing passage that opens in the lower abutment surface and extends upward. The converging groove forms a plurality of converging passages that connect openings of the stem-communicated passages and an opening of the mixing passage when the nozzle lower part and the nozzle upper part are fitted with each other.

Advantageous Effects of Invention

According to claim 1, at least one of the upper abutment surface and lower abutment surface of the aerosol nozzle includes a converging groove that connects openings of the plurality of stem-communicated passages, and the converging groove forms a plurality of converging passages that connect openings of the stem-communicated passages and an opening of the mixing passage when the nozzle lower part and the nozzle upper part are fitted with each other. The aerosol nozzle, which mixes a plurality of contents traveling from a plurality of converging passages toward a mixing passage at the opening of the mixing passage and ejects them, can be achieved only by fitting together the nozzle lower part and the nozzle upper part configured in simple shapes, and thereby a reduction in production and assembling can be achieved.

Converging passages of various shapes conforming to the shape, depth and the like of the converging groove can be readily formed in accordance with the types and characteristics of contents or purposes of use, which enables uniform mixing and ejection of a plurality of contents.

The shape and depth of the converging groove can be set to form converging passages with a small capacity that enables uniform mixing, so that it is possible to reduce the amount of contents left in the passages after ejection.

According to the configuration set forth in claim 2, the plurality of converging passages include a flow line other than a straight line connecting center lines of the stem-connected passages and a center line of the mixing passage, so that the mixing of a plurality of contents directly below the mixing passage is further promoted and thus the contents can be mixed uniformly.

According to the configuration set forth in claim 3, the plurality of converging passages include passages of different shapes, so that a plurality of contents of different types or characteristics can be mixed uniformly and ejected.

According to the configuration set forth in claim 4, a mixing space that connects the plurality of converging passages and the mixing passage is formed in at least one of the lower abutment surface and the upper abutment surface, so that a plurality of contents can be mixed uniformly inside the mixing space.

Since the mixing space is provided directly below the mixing passage, the passage capacity can be made smaller, and the amount of contents remaining in the passages after ejection can be reduced.

According to the configuration set forth in claim 5, the nozzle upper part and nozzle lower part are integrally formed and coupled together at a hinge part, so that the production and assembling costs can be further reduced.

REFERENCE SIGNS LIST

Figure 1:
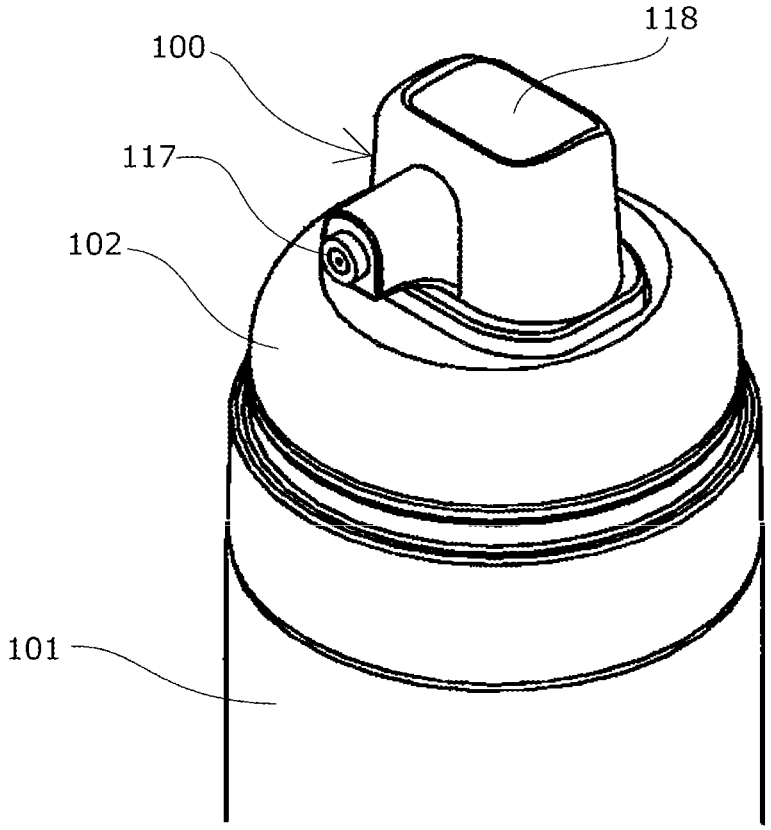
FIG. 1 is a perspective view of an aerosol nozzle when mounted to a container according to one embodiment of the present invention.
Figure 2A:
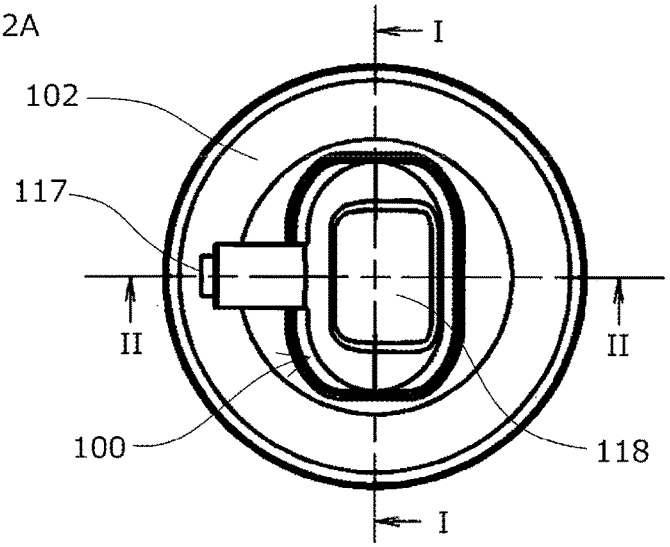
FIG. 2A is a plan view of FIG. 1.
Figure 2B:
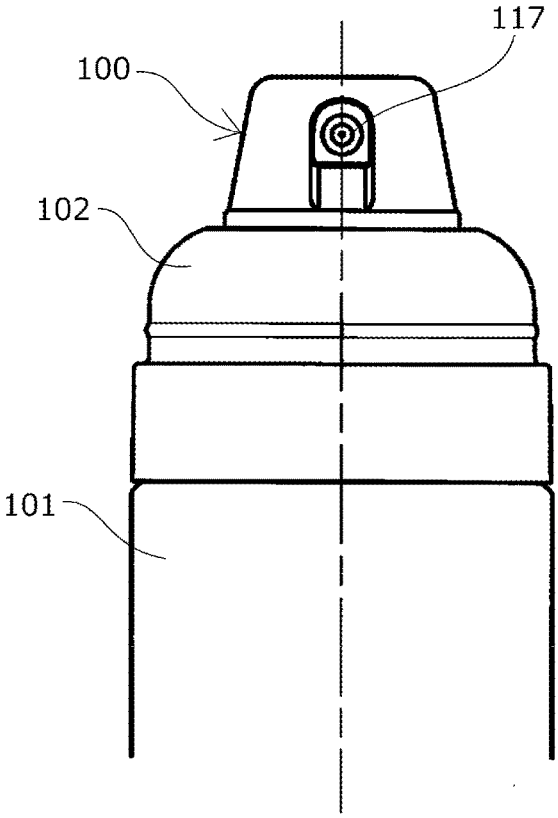
FIG. 2B is a front view of FIG. 1.
Figure 2C:
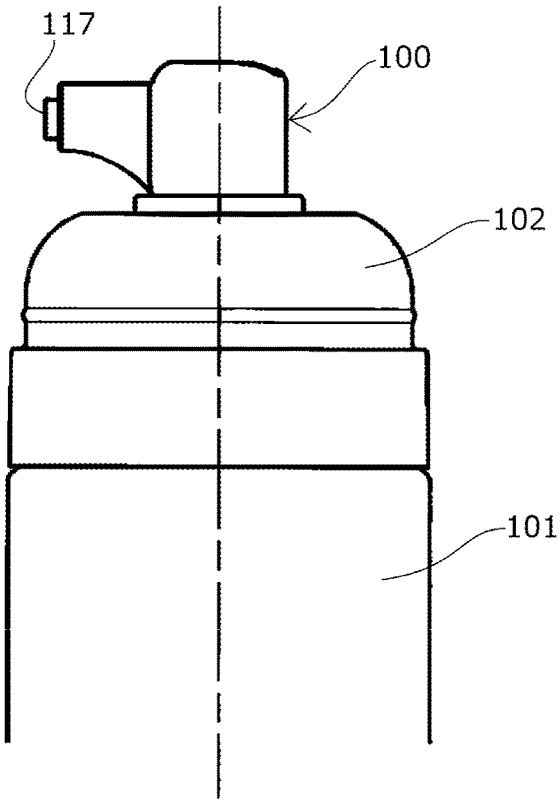
FIG. 2C a side view of FIG. 1.
Figure 3A:
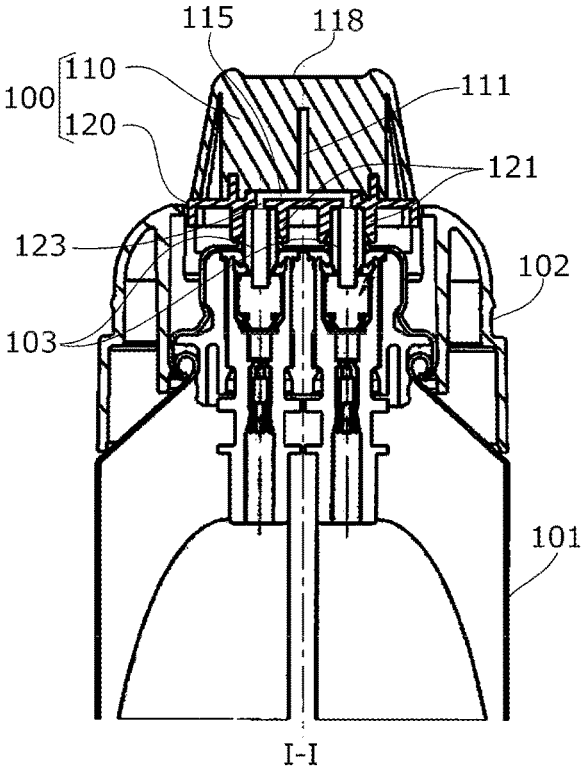
FIG. 3A is a I-I cross-sectional view of FIG. 2A.
Figure 3B:
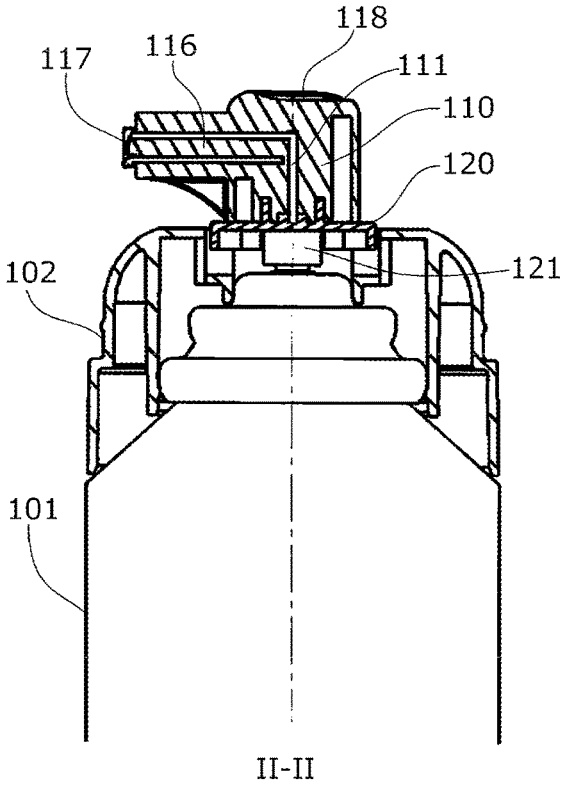
FIG. 3B is a II-II cross-sectional view of FIG. 2A.
Figure 4A:
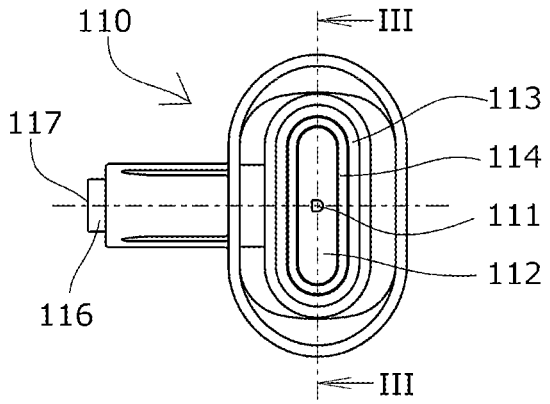
FIG. 4A is a plan view of abutment surfaces of a nozzle upper part of the aerosol nozzle according to a first embodiment of the present invention.
Figure 4B:
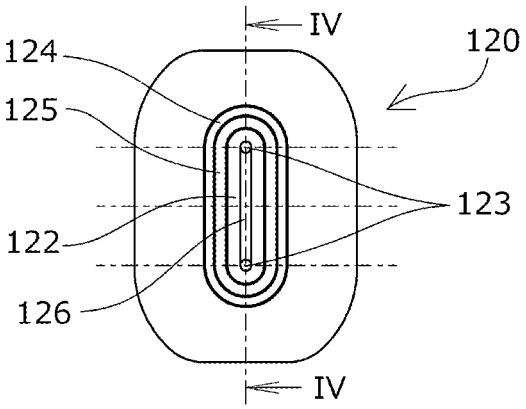
FIG. 4B is a plan view of abutment surfaces of a nozzle lower part of the aerosol nozzle according to a first embodiment of the present invention.
Figure 5A:
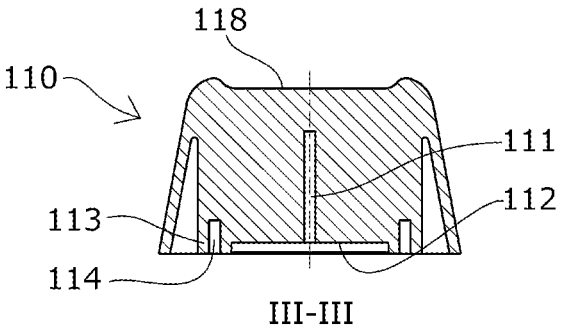
FIG. 5A is a cross-sectional view of FIG. 4A.
Figure 5B:
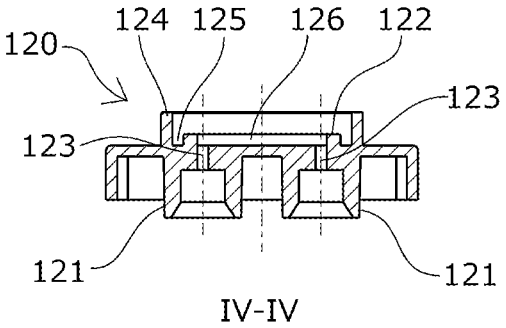
FIG. 5B is a IV-IV cross-sectional view of FIG. 4B.

100 Aerosol nozzle
101 Aerosol container
102 Shoulder cover
103 Stem
110 Nozzle upper part
111 Mixing passage
112 Lower abutment surface
113 Outer peripheral fitting concave portion
114 Inner peripheral fitting convex portion
115 Converging passage convex portion
116 Center post
117 Ejection port
118 Pressing part
119 Press-down contact part
120 Nozzle lower part
121 Stem fitting part
122 Upper abutment surface
123 Stem-communicated passage
124 Outer peripheral fitting convex portion
125 Inner peripheral fitting concave portion
126 Converging groove
131 Conversing passage
132 Mixing space

DESCRIPTION OF EMBODIMENT

An aerosol nozzle according to the present invention may be embodied in any specific form as long as it includes a nozzle lower part that fits with a plurality of stems protruding from an aerosol container, and a nozzle upper part that fits with the nozzle lower part, the nozzle lower part including stem fitting parts that fit with the plurality of stems respectively, an upper abutment surface, and stem-communicated passages that open in the upper abutment surface and extend through the nozzle lower part from the stem fitting parts, the nozzle upper part including a lower abutment surface, and a mixing passage that opens in the lower abutment surface and extends upward, at least one of the upper abutment surface and lower abutment surface having a converging groove that connects openings of the plurality of the stem-communicated passages, the converging groove forming a plurality of converging passages that connect openings of the stem-communicated passages and an opening of the mixing passage when the nozzle lower part and nozzle upper part are fitted with each other.

First Embodiment

The aerosol nozzle 100 according to a first embodiment of the present invention includes, as shown in FIG. 1 to FIG. 5B, a nozzle lower part 120 that fits with two stems 103 protruding from an aerosol container 101, and a nozzle upper part 110 that fits with the nozzle lower part 120.

The nozzle lower part 120 includes stem fitting parts 121 that each fit with each of the two stems 103, an upper abutment surface 122, stem-communicated passages 123 that open in the upper abutment surface 122 and extending through the nozzle lower part from the stem fitting parts 121, a converging groove 126 that connects the openings of the stem-communicated passages 123 in a straight line, an inner peripheral fitting concave portion 125 that surrounds the upper abutment surface 122, and an outer peripheral fitting convex portion 124 that surrounds the inner peripheral fitting concave portion 125.

The nozzle upper part 110 includes a lower abutment surface 112, a mixing passage 111 that opens in the lower abutment surface 112 and extends upward, an inner peripheral fitting convex portion 114 that surrounds the lower abutment surface 112, and an outer peripheral fitting concave portion 113 that surrounds the inner peripheral fitting convex portion 114, a center post 116 extending horizontally from near the upper end of the mixing passage 111, an ejection port 117, and a pressing part 118.

The nozzle lower part 120 and nozzle upper part 110 together form a converging passage 131 that connects the openings of the stem-communicated passages 123 and the opening of the mixing passage 111 in a straight line, as the upper abutment surface 122 and the lower abutment surface 112 fit with each other in tight contact, whereby the lower abutment surface 112 above the converging groove 126 covers the groove.

Next, the actions when the two liquids are mixed and ejected by the aerosol nozzle 100 of this embodiment will be described.

The aerosol nozzle 100 is disposed such that the stem fitting parts 121 are fitted to the two stems 103 protruding from the aerosol container 101.

When the pressing part 118 of the aerosol nozzle 100 is pushed down, the two stems 103 are pressed down, so that respective valve mechanisms of the two stems 103 are opened simultaneously, upon which the contents inside the aerosol container 101 flow through the stems and into the aerosol nozzle 100 by the pressure of a propellant filled inside the aerosol container 101.

The contents each flowing out from the two stems 103 travel through their respective stem-communicated passages 123 and the converging passage 131, and meet near the opening of the mixing passage 111. The contents are mixed sufficiently as they travel through the mixing passage 111, and ejected through the outer periphery of the center post 116 and from the ejection port 117.

The nozzle lower part 120 and nozzle upper part 110 of the aerosol nozzle 100 are fitted with each other such that the inner peripheral fitting convex portion 114 is press-fit in the inner peripheral fitting concave portion 125, and the outer peripheral fitting convex portion 124 is press-fit in the outer peripheral fitting concave portion 113, these surrounding the upper abutment surface 122 and lower abutment surface 112. Therefore, when, in an unlikely event, the liquid contents seep through between the upper abutment surface 122 and lower abutment surface 112, the liquid does not leak out other than from the ejection port 117 of the aerosol nozzle 100.

The passages are formed to have a small volume, so that the amount of the contents that remain inside the aerosol nozzle 100 after the contents have been ejected can be reduced, and the possibility of the contents leaking out from the ejection port 117 can be reduced.

In the description of the embodiments below, the features common to the first embodiment will be omitted.

Second Embodiment

Figure 6A:
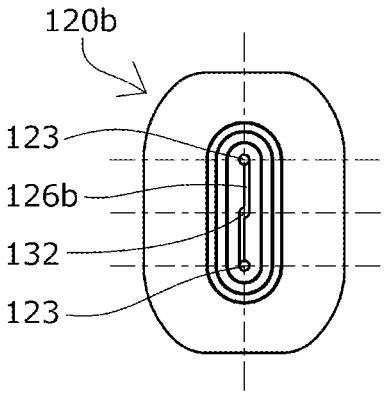
FIG. 6A is a plan view of abutment surfaces of nozzle lower parts of aerosol nozzles according to a second embodiment of the present invention.

In the aerosol nozzle according to a second embodiment of the present invention, as shown in FIG. 6A, converging grooves 126*b* of the nozzle lower part 120*b* include one tangent line of each of the stem-communicated passages 123 as the inner walls, and have a groove width that is half of the inner diameter of each of the stem-communicated passages 123. The two converging grooves 126*b* do not intersect each other and are disposed such as to connect each of the stem-communicated passages 123 and the opening of the mixing passage 111. A mixing space 132 is formed in a portion of the upper abutment surface 122 below the opening of the mixing passage 111. The inner walls of the two converging grooves 126*b* include a common tangent line of each stem-communicated passage 123 and the mixing space 132.

This creates a swirl in the contents inside the mixing space 132 so that the mixing as the contents travel through the mixing passage 111 is further promoted.

Figure 6B:
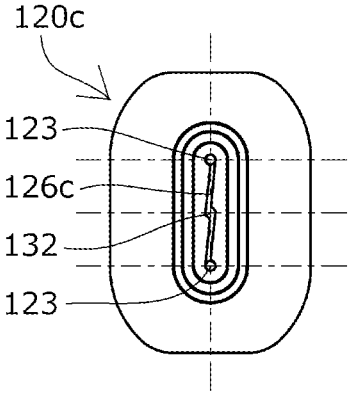
FIG. 6B is a plan view of abutment surfaces of nozzle lower parts of aerosol nozzles according to a third embodiment of the present invention.

Third Embodiment in the aerosol nozzle according to a third embodiment of the present invention, as shown in FIG. 6B, converging grooves 126*c* of the nozzle lower part 120*c* include a common tangent line of both stem-communicated passages 123 as the inner walls, and have a groove width that is half of the inner diameter of each of the stem-communicated passages 123. The two converging grooves 126*c* do not intersect each other and are disposed such as to connect each of the stem-communicated passages 123 and the opening of the mixing passage 111.

A mixing space 132 is formed in a portion of the upper abutment surface 122 below the opening of the mixing passage 111. The two converging grooves 126*c* have a tangent line of the mixing space 132 separately of the tangent line of each stem-communicated passage 123 as the inner walls.

This creates a swirl in the contents inside the mixing space 132 similarly to the second embodiment so that the mixing as the contents travel through the mixing passage 111 is further promoted.

Figure 6C:
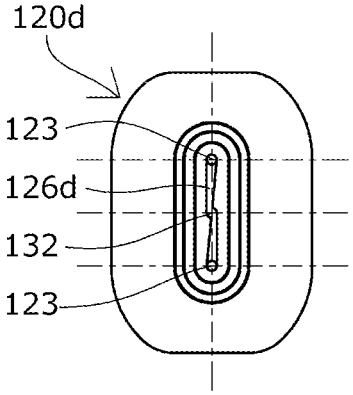
FIG. 6C is a plan view of abutment surfaces of nozzle lower parts of aerosol nozzles according to a fourth embodiment of the present invention.

Fourth Embodiment in the aerosol nozzle according to a fourth embodiment of the present invention, as shown in FIG. 6C, converging grooves 126*d* of the nozzle lower part 120*d* include two non-parallel tangent lines of each of the stem-communicated passages 123 as the inner walls.

The two converging grooves 126*d* do not intersect each other and are disposed such as to connect each of the stem-communicated passages 123 and the opening of the mixing passage 111.

A mixing space 132 is formed in a portion of the upper abutment surface 122 below the opening of the mixing passage 111. The inner walls of the two converging grooves 126*d* include a common tangent line of each stem-communicated passage 123 and the mixing space 132.

The cross-sectional area of the converging grooves 126*d* is reduced toward the mixing space 132, so that the flow speed of the passing contents is increased. Thus the swirl in the mixing space 132 is accelerated, and the mixing as the contents travel through the mixing passage 111 is further promoted.

Fifth Embodiment

Figure 6D:
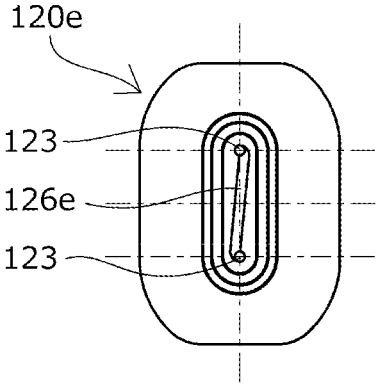
FIG. 6D is a plan view of abutment surfaces of nozzle lower parts of aerosol nozzles according to a fifth embodiment of the present invention.

In the aerosol nozzle according to a fifth embodiment of the present invention, as shown in FIG. 6D, a converging groove 126*e* of the nozzle lower part 120*e* is disposed such as to connect each of the stem-communicated passages 123 and the opening of the mixing passage 111 in a straight line.

The converging groove 126*e* is formed in the position which is, in relation to the converging groove 126 of the first embodiment, rotated clockwise around the center axis of the mixing passage 111 as the rotation axis by about half of the opening of the stem-communicated passages 123.

Even though a mixing space is not provided, a swirl is created inside the mixing passage 111, so that the mixing as the contents travel through is promoted.

Sixth Embodiment

Figure 6E:
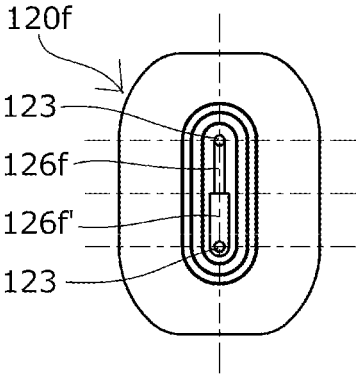
FIG. 6E is a plan view of abutment surfaces of nozzle lower parts of aerosol nozzles according to a sixth embodiment of the present invention.

In the aerosol nozzle according to a sixth embodiment of the present invention, as shown in FIG. 6E, converging grooves 126*f* and 126*f'* of the nozzle lower part 120*f* are disposed such as to connect each of the stem-communicated passages 123 and the opening of the mixing passage 111 in a straight line. The groove width of the converging groove 126*f* is the same as the inner diameter of the stem-communicated passage 123, while the groove width of the converging groove 126*f'* is larger than the inner diameter of the stem-communicated passage 123.

This allows for selection of the width of each converging groove 126*f* and 126*f'* as required, which in turn enables setting of mixture ratios Other than 1:1 of the two contents to be mixed, and enables usage of two contents that have different viscosities or the like.

Figure 7A:
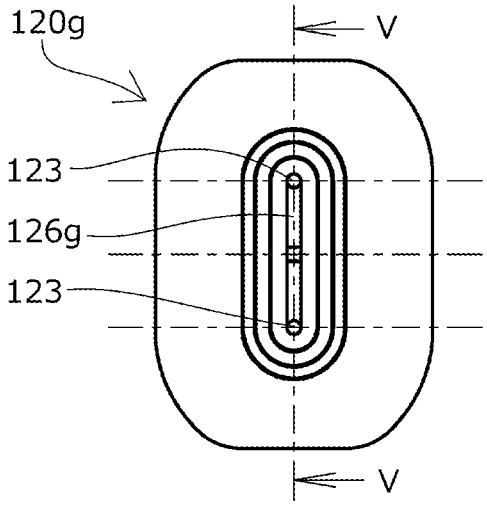
FIG. 7A is a plan view of abutment surfaces of nozzle lower parts of aerosol nozzles according to a seventh embodiment of the present invention.
Figure 7B:
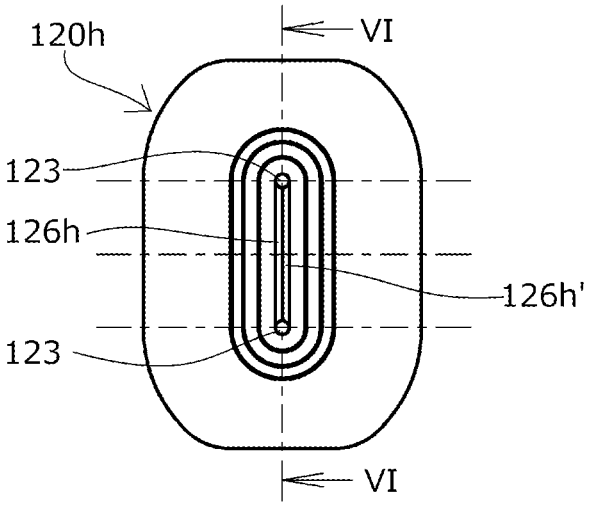
FIG. 7B is a plan view of abutment surfaces of nozzle lower parts of aerosol nozzles according to an eighth embodiment of the present invention.
Figure 7C:
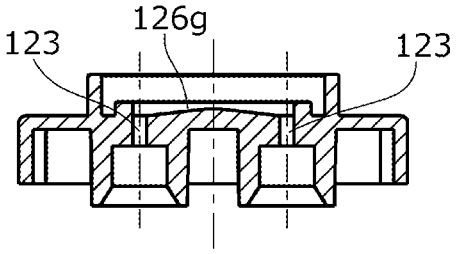
FIG. 7C is a V-V cross-sectional view of abutment surfaces of nozzle lower parts of aerosol nozzles according to a seventh embodiment of the present invention.

Seventh Embodiment in the aerosol nozzle according to a seventh embodiment of the present invention, as shown in FIG. 7A and FIG. 7C, a converging groove 126*g* of the nozzle lower part 120*g* is disposed such as to connect each of the stem-communicated passages 123 and the opening of the mixing passage 111 in a straight line. The converging groove 126*g* is formed such that the groove depth reduces from each stem-communicated passage 123 toward the opening of the mixing passage 111.

The cross-sectional area of the converging groove 126*g* is reduced toward the mixing passage 111, so that the flow speed of the passing contents is increased. Thus the mixing as the contents travel through the mixing passage 111 is further promoted.

Eighth Embodiment

Figure 7D:
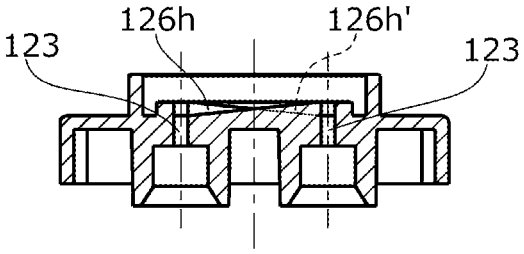
FIG. 7D is a VI-VI cross-sectional view of abutment surfaces of nozzle lower parts of aerosol nozzles according to an eighth embodiment of the present invention.

In the aerosol nozzle according to an eighth embodiment of the present invention, as shown in FIG. 7B and FIG. 7D, converging grooves 126*h* and 126*h'* of the nozzle lower part 120*h* include a tangent line common to both stem-communicated passages 123 as the inner walls, and have a groove width that is half of the inner diameter of each of the stem-communicated passages 123.

The two converging grooves 126*h* and 126*h'* do not intersect each other and are disposed such as to connect each of the stem-communicated passages 123 and the opening of the mixing passage 111 in a straight line. The converging grooves 126*h* and 126*h'* are connected to different stem-communicated passages 123 and formed such that the groove depth reduces toward the other stem-communicated passages 123.

The cross-sectional area of the converging groove 126*h* is reduced toward the mixing passage 111, so that the flow speed of the passing contents is increased. Even though a mixing space is not provided, a swirl is created inside the mixing passage 111, so that the mixing as the contents travel through is promoted.

Ninth Embodiment

Figure 8A:
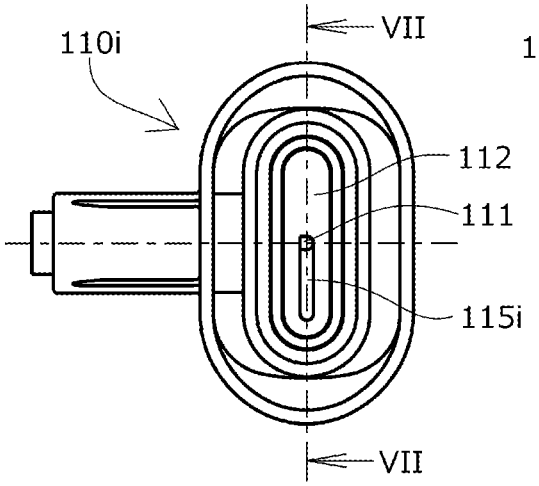
FIG. 8A is a plan view of abutment surfaces of a nozzle upper part of an aerosol nozzle according to a ninth embodiment of the present invention.
Figure 8B:
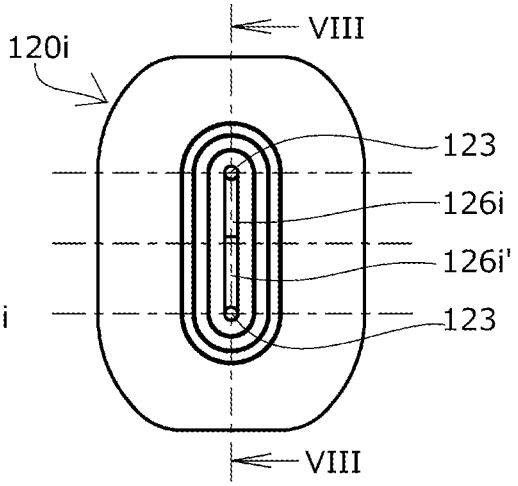
FIG. 8B is a plan view of abutment surfaces of a nozzle lower part of an aerosol nozzle according to a ninth embodiment of the present invention.
Figure 9A:
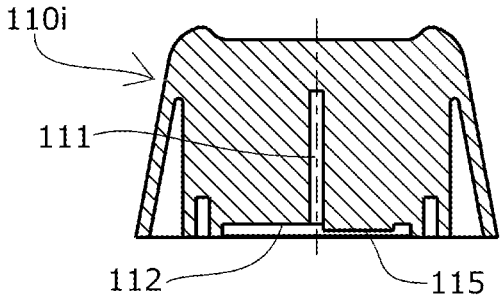
FIG. 9A is a VII-VII cross-sectional view of FIG. 8A.
Figure 9B:
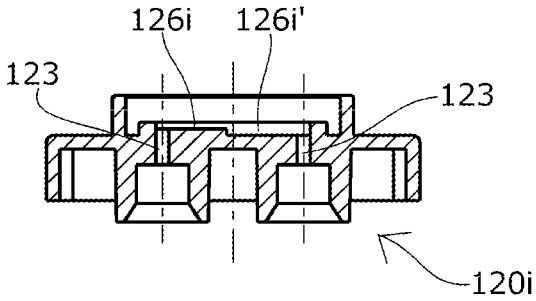
FIG. 9B is a VIII-VIII cross-sectional view of FIG. 8B.
Figure 9C:
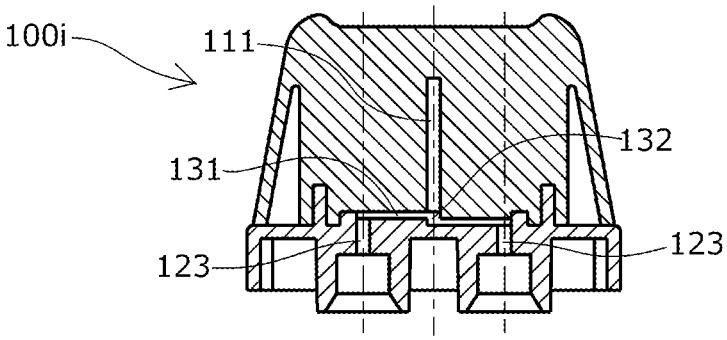
FIG. 9C is a cross-sectional view when assembled.

In the aerosol nozzle 100*i* according to a ninth embodiment of the present invention, as shown in FIG. 8 and FIG. 9, converging grooves 126*i* and 126*i'* of the nozzle lower part 120*i* are disposed such as to connect each of the stem-communicated passages 123 and the opening of the mixing passage 111 in a straight line, with a groove width equal to the inner diameter of the stem-communicated passages 123.

The converging groove 126*i* is formed shallower than the converging groove 126*i'*, and a mixing space 132 is formed in a portion of the upper abutment surface 122 below the opening of the mixing passage 111.

The lower abutment surface 112 of the nozzle upper part 110*i* includes a converging passage convex portion 115 capable of fitting with the converging groove 126*i'*. With the nozzle upper part 110*i* and nozzle lower part 120*i* fitting with each other, the converging passage 131 forms a stepped passage of an equal cross-sectional flow area with the converging groove 126*i* and the converging groove 126*i'*.

This creates a swirl in the vertical direction in the contents in the mixing space 132, so that the mixing as the contents pass through the mixing passage 111 is further promoted.

Tenth Embodiment

Figure 10A:
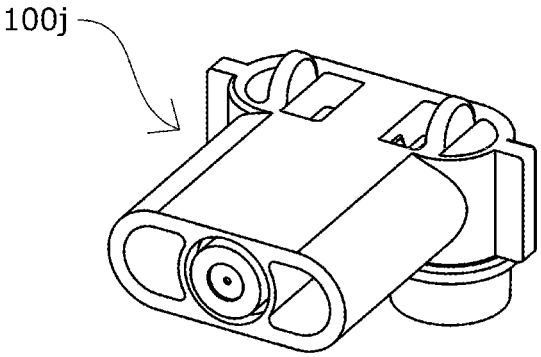
FIG. 10A is a perspective view of an aerosol nozzle according to a tenth embodiment of the present invention.
Figure 10B:
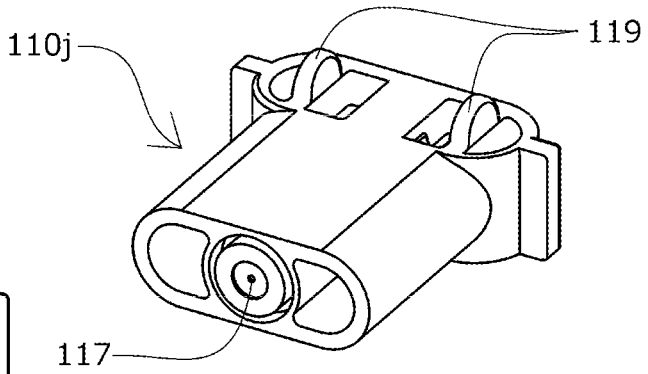
FIG. 10B is a nozzle upper part according to a tenth embodiment of the present invention.
Figure 10C:
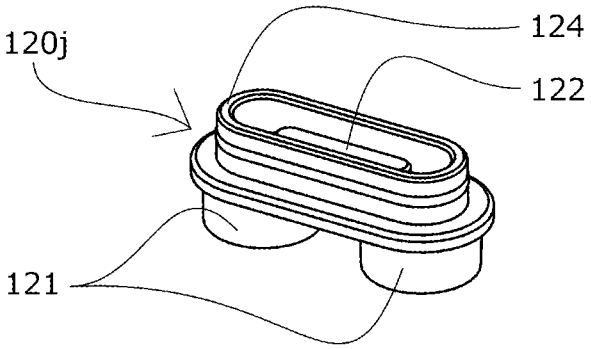
FIG. 10C is a nozzle lower part according to a tenth embodiment of the present invention.

The aerosol nozzle 100*j* according to a tenth embodiment of the present invention includes a nozzle upper part 110*j* and a nozzle lower part 120*j*, as shown in FIG. 10. No pressing part that is pressed directly with a finger is provided to the nozzle upper part 110*j*, which instead includes a press-down contact part 119.

When the nozzle lower part 120*j* and nozzle upper part 110*j* are fitted with each other, a plurality of converging passages that connect the openings of the stem-communicated passages and the opening of the mixing passage are formed similarly to the previously described embodiments, which may take any form, including those of the previously described embodiments.

The nozzle 100*j* according to this embodiment is applied to a cover member (not shown) that has a lever (not shown) capable of touching and pressing the press-down contact part 119 of the nozzle 100*j*, so that the contents can be ejected by pressing down the lever, which then presses the press-down contact part 119 of the nozzle 100*j*.

This allows for change of the appearance of the upper part of the aerosol product by replacing the cover members as desired without changing the shape of the nozzle 100*j*. Also, the pressing of the nozzle 100*j* by the pressed-down lever enables the two stems 103 to be pressed evenly via the nozzle 100*j*, so that the simultaneity of ejecting two liquids is further improved.

While embodiments of the present invention have been described above in detail, the present invention is not limited to the above-described embodiments and may be carried out with various design changes without departing from the scope of the present invention set forth in the claims.

For example, while the aerosol nozzle of the embodiments described above is mounted to an aerosol container with two stems protruding therefrom, the number of stems is not limited to two, and there may be three or more protruding stems. It is only necessary to prepare an aerosol nozzle that has, as required, stem fitting parts corresponding to the number of stems and the protruding position of each stem, and a converging groove corresponding to each stem.

Also, while the aerosol nozzle of the embodiments described above is mounted to one aerosol container with two stems protruding therefrom, the number of aerosol container is not limited to one, and the nozzle may be mounted to a plurality of aerosol containers arranged side by side, with one or a plurality of stems protruding therefrom.

While the contents mixed inside the mixing space or mixing passage is passed around the center post and ejected horizontally from the ejection port in the aerosol nozzle of the embodiments described above, the direction of ejection and the passage after the mixing passage are not limited. For example, the contents may be ejected vertically from the tip of the mixing passage, and the center post and ejection port may be omitted.

While the converging groove is provided in the upper abutment surface of the nozzle lower part in the aerosol nozzle of the embodiments described above, the converging groove may be provided in the lower abutment surface of the nozzle upper part, or to both of the lower abutment surface and upper abutment surface.

While the converging groove is formed substantially straight in the aerosol nozzle of the embodiments described above, the shape of the converging groove is not limited to straight line. For example, the groove may be formed in a circular arc from each stem-communicated passage to the mixing passage, or may have a bent shape, or meandering shape.

While the mixing passage is provided at an equidistant position from both stem-communicated passages in the aerosol nozzle of the embodiments described above, the position of the mixing passage is not limited. For example, it may be located closer to one stem and farther from the other stem.

While the converging groove connecting to each of the stem-communicated passages is a single groove in the aerosol nozzle of the embodiments described above, the number of connected converging groove is not limited to one. For example, two converging grooves may be connected to one stem-communicated passage.

While the nozzle upper part and nozzle lower part are separate components in the aerosol nozzle of the embodiments described above, the nozzle upper part and nozzle lower part may be integrally molded and coupled together by a hinge or the like.

While the two stems are fixed in position at substantially the same height in the aerosol nozzle of the embodiments described above, the two stems need not necessarily be fixed in position at the same height. For example, a nozzle lower part that has stem fitting parts with different heights corresponding to two stems fixed at different heights may be used.

The invention claimed is:

1. An aerosol nozzle, comprising a nozzle lower part that fits with a plurality of stems protruding from an aerosol container, and a nozzle upper part that fits with the nozzle lower part, wherein the nozzle lower part includes stem fitting parts that fit with the plurality of stems respectively, an upper abutment surface, and stem-communicated passages that open in the upper abutment surface and extend through the nozzle lower part from the stem fitting parts, the nozzle upper part includes a lower abutment surface, and a mixing passage that opens in the lower abutment surface and extends upward, at least one of the upper abutment surface and the lower abutment surface has a converging groove that connects openings of a plurality of the stem-communicated passages, the converging groove forms a plurality of converging passages that connect openings of the stem-communicated passages and an opening of the mixing passage when the nozzle lower part and the nozzle upper part are fitted with each other, and cross-sectional areas of each of the plurality of converging passages are configured to differ from each other or to vary along directions that the converging passages extend.

2. The aerosol nozzle according to claim 1, wherein the plurality of converging passages include a flow line other than a straight line connecting center lines of the stem-connected passages and a center line of the mixing passage.

3. The aerosol nozzle according to claim 1, wherein the plurality of converging passages include passages of different shapes.

4. The aerosol nozzle according to claim 1, wherein a mixing space that connects the plurality of converging passages and the mixing passage is formed in at least one of the lower abutment surface and the upper abutment surface.

5. The aerosol nozzle according to claim 1, wherein the nozzle upper part and the nozzle lower part are molded integrally and coupled together by a hinge part.

6. The aerosol nozzle according to claim 1, wherein said cross-sectional areas of each of the plurality of converging passages being configured to differ from each other includes a width of a first of said plurality of converging passages being larger than a second of said plurality of converging passages.

7. The aerosol nozzle according to claim 1, wherein said cross-sectional areas of each of the plurality of converging passages are configured to vary along directions that the converging passages extend includes that the cross-sectional areas of the converging grooves are reduced toward the mixing space such that the flow speed of passing contents is increased.

8. An aerosol nozzle, comprising a nozzle lower part that fits with a plurality of stems protruding from an aerosol container, and a nozzle upper part that fits with the nozzle lower part, wherein the nozzle lower part includes stem fitting parts that fit with the plurality of stems respectively, an upper abutment surface, and stem-communicated passages that open in the upper abutment surface and extend through the nozzle lower part from the stem fitting parts, the nozzle upper part includes a lower abutment surface, and a mixing passage that opens in the lower abutment surface and extends upward, at least one of the upper abutment surface and the lower abutment surface has a converging groove that connects openings of a plurality of the stem-communicated passages, the converging groove forms a plurality of converging passages that connect openings of the stem-communicated passages and an opening of the mixing passage when the nozzle lower part and the nozzle upper part are fitted with each other, and the nozzle upper part and the nozzle lower part are molded integrally and coupled together by a hinge part.

* * * * *